US005313682A

United States Patent [19]

Chamieh

[11] Patent Number: 5,313,682

[45] Date of Patent: May 24, 1994

[54] HAND HELD DOMESTIC UTENSIL CLEANING DEVICE

[76] Inventor: Naji Chamieh, 13206 Summertime Ln., Culver City, Calif. 90230

[21] Appl. No.: 65,355

[22] Filed: May 19, 1993

[51] Int. Cl.[5] ..... A46B 13/06

[52] U.S. Cl. ..... 15/29

[58] Field of Search ..... 15/24, 29, 97.1, 50.1

[56] References Cited

U.S. PATENT DOCUMENTS

| | | | |
|---|---|---|---|
| 1,212,967 | 1/1917 | Light et al. | 15/29 |
| 1,694,733 | 12/1928 | Cummins | 15/29 |
| 3,074,088 | 1/1963 | Williams | 15/29 |
| 4,207,640 | 6/1980 | Sekula et al. | 15/29 |
| 4,279,051 | 7/1981 | Malcolm | 15/29 |
| 4,327,454 | 5/1982 | Spence | 15/29 |
| 4,461,052 | 7/1984 | Mostul | 15/29 |
| 4,532,666 | 8/1985 | Smyth | 15/29 |
| 5,129,121 | 7/1992 | Gelman | 15/29 |

*Primary Examiner*—Edward L. Roberts
*Attorney, Agent, or Firm*—Drucker & Sommers

[57] ABSTRACT

A water operated rotatable scrubbing brush device which generates considerable scrubbing torque, without the use of gearing or diverting the majority of the water driving the device away from the brush and out of the device. The device has a two-way water flow valve that permits the operator to select between a rotatable scrubbing brush mode, wherein liquid cleaning solution will also be dispensed to the scrubbing brush, and a rinse mode, wherein clean rinse water, without cleaning solution, will be dispensed without driving the scrubbing brush, to rinse off the item being scrubbed.

7 Claims, 5 Drawing Sheets

HAND HELD DOMESTIC UTENSIL CLEANING DEVICE

BACKGROUND OF THE INVENTION

1. Field of the Invention

The invention relates to the field of water operated rotating scrubbing brush devices, and more particularly to a device which generates a high amount of torque, without the use of any gearing.

2. Description of the Prior Art

There are a number of different styles of water operated rotating brush cleaning devices. However, all of these devices have drawbacks, as will be discussed below.

U.S. Pat. No. 4,207,640 to Sekula, et al. discloses a device with a rotating brush and a built-in liquid washing agent feeder. The Sekula, et al. device comprises a sealed chamber containing a disk with vanes located around its perimeter. The disk is connected to the rotating brush via a hollow shaft. A single nozzle positioned at the perimeter of the sealed chamber directs water at the vanes, thereby turning the disk and brush. After turning the disk, the water drains out of the sealed chamber through a channel in the hollow shaft to the brush below. The Sekula, et al. device, due to its single nozzle for turning the rotatable disk and the attached brush, would not be expected to develop sufficient torque with which to rotate the brush when the brush is brought into contract with the item being washed, such as a vehicle. This problem would likely be compounded by the limited rate at which water would be expected to drain from the device, and the accompanying backpressure in the device which might result. Moreover, the Sekula, et al. device just has a single, water driven brushing mode, during which soap will be dispensed, but no other mode where just clean water can be dispensed directly from the brush.

U.S. Pat. No. 4,370,771 to Gonzalvo discloses a water-driven brush device for washing dishes that is connected to a sink faucet. The full force of the inlet water drives a turbine. The turbine drives a brush through gears to thereby increase the available torque. After turning the turbine, the majority of the water is directed through an outlet hose away from the brush, with only a minority of water being directed to the brush. The Gonzalvo device does not include a means to distribute cleaning solution to the item being washed and also lacks any means to choose between a scrubbing mode and a rinse mode. Moreover, while gearing may increases the available torque, the rotation speed of the brush is thereby lowered, and the overall design becomes more complex.

U.S. Pat. No. 2,599,911 to Haines describes a water operated rotary cleaning brush device similar to the Gonzalvo device, in that once the inlet water finishes turning a turbine, the majority of the water is directed out of the device, away from the brush, and is not available for washing the item being scrubbed. The Haines device has a single, scrubbing mode of operation, but no rinse mode of operation, and soap distribution system.

SUMMARY OF THE INVENTION

The invention provides a water-operated rotating scrubbing brush device which generates considerable scrubbing torque, without the use of gearing or diverting the majority of the water driving the device away from the brush and out of the device.

The invention provides a water operated rotatable scrubbing brush device, comprising:

a non-rotatable body portion;

a rotatable scrubbing disk plate which is rotatably carried on an underside of said non-rotating body, said rotating scrubbing disk plate carrying scrubbing members on an underside thereof, and a plurality of water vanes located on its circumference;

a two way valve with a water inlet for connection to a water supply, and two outlets through which water can be selectively directed, the first outlet being in fluid communication with a rinse water channel which exits the device, and a second outlet which is in fluid communication with a wash water channel, said wash water channel being in fluid communication with a plurality of jets which are aligned to direct water flowing therefrom to the vanes on the circumference of the rotating scrubbing disk plate, and thereby drive the rotating scrubbing disk plate, whereas when the user of the device desires to actuate a rotating scrubbing mode of the device, the user positions the two-way valve to direct water through the wash water channel and jets, and when the user wishes to actuate the rinse mode of the device, the user positions the two-way valve to direct water through the rinse water channel, so that the water exits the device without rotating the rotatable scrubbing disk plate.

The invention further provides a water operated rotatable scrubbing brush device, comprising:

a non-rotatable body portion with a container for containing a liquid cleaning solution, said container having a bottom wall with apertures formed therethrough from which the liquid cleaning solution can exit;

a rotatable scrubbing disk plate which is rotatably carried on an underside of said non-rotatable body, said rotatable scrubbing disk plate carrying scrubbing brush members on an underside thereof, and a plurality of water vanes located on its circumference; and a two-way valve with a water inlet for connection to a water supply, and two outlets through which water can be selectively directed, a first outlet being in fluid communication with a rinse water channel which exits along an axis line of the rotatable scrubbing disk plate, and a second outlet which is in fluid communication with a wash water channel, said wash water channel being in fluid communication with a plurality of jets which are aligned to direct water flowing therefrom to the vanes on the circumference of the rotatable scrubbing disk plate, and thereby drive the rotatable scrubbing disk plate, said wash water channel having an aperture formed therethrough and in communication with the container of the non-rotatable body portion, wherein said rotatable scrubbing disk plate is rotatably mounted on an extension of the rinse water channel which extends downwardly from the underside of the non-rotatable body portion, thereby allowing rinse water to exit from the rinse water channel without intercepting the rotatable scrubbing disk plate; whereby when the user of the device desires to actuate a rotatable scrubbing mode of the device, the user positions the two-way valve so as to direct water through the wash water channel and jets, which directs a portion of the water flowing through the wash water channel, through the aperture formed therein, and into the container, thereby forcing liquid cleaning solution out of the container through the aperture formed on its bottom wall and onto the rotatable scrubbing disk plate, and when the user wishes to actuate the rinse mode of the device, the user positions the two-way valve to direct water through the rinse water channel, so that the water exits the device without rotating the rotatable scrubbing disk plate and without drawing any liquid cleaning solution into the rinse water.

BRIEF DESCRIPTION OF THE DRAWINGS

The invention is described below in greater detail with reference to the drawings.

DESCRIPTION OF THE PREFERRED EMBODIMENTS

Figure 1:
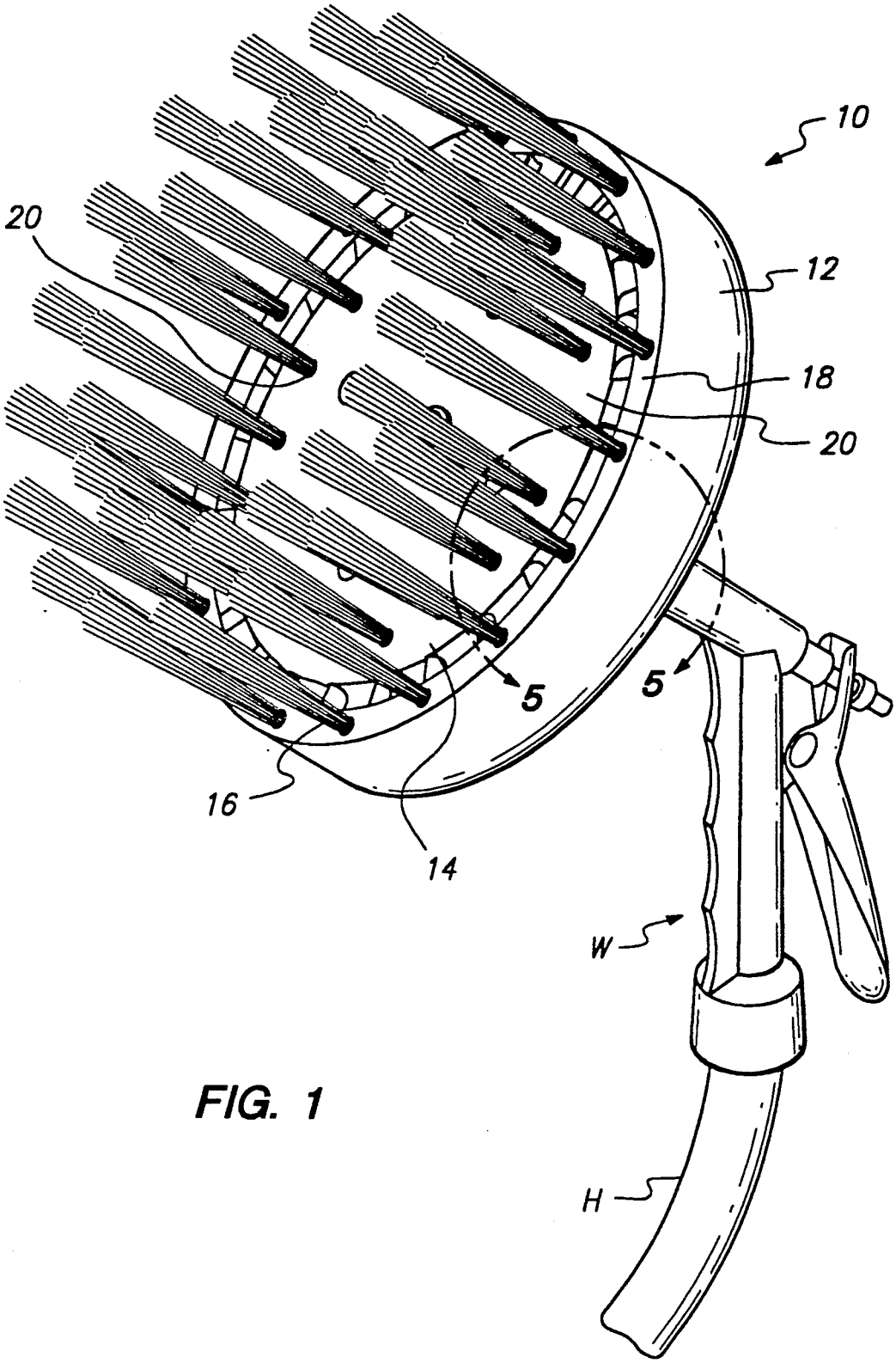
FIG. 1 is a bottom perspective view of the device, shown as it can be used in conjunction to a hand grip water nozzle attached to a garden hose.
Figure 2:
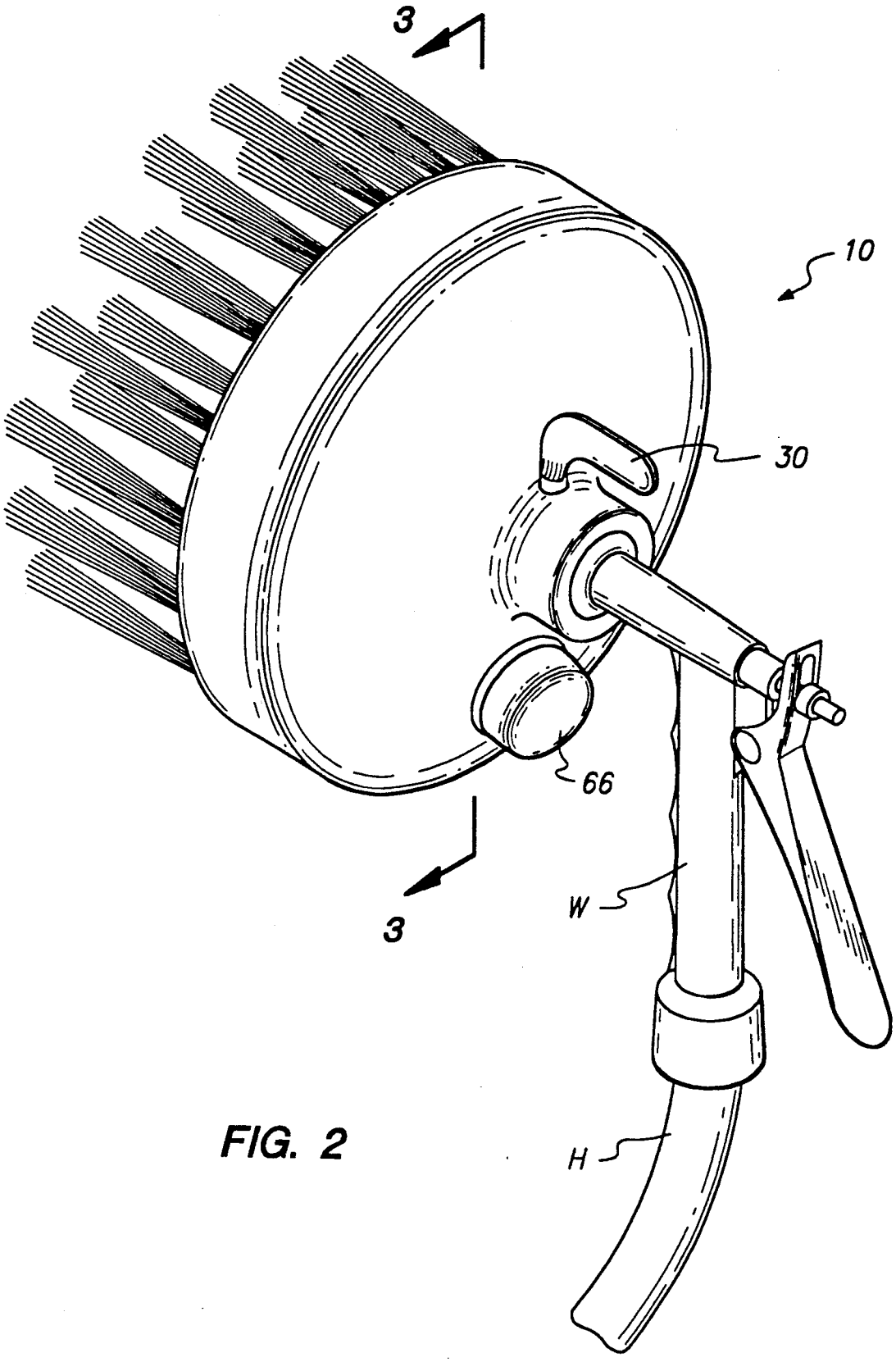
FIG. 2 is a top perspective view of the device, shown as it can be used in conjunction to a hand grip water nozzle attached to a garden hose.
Figure 3:
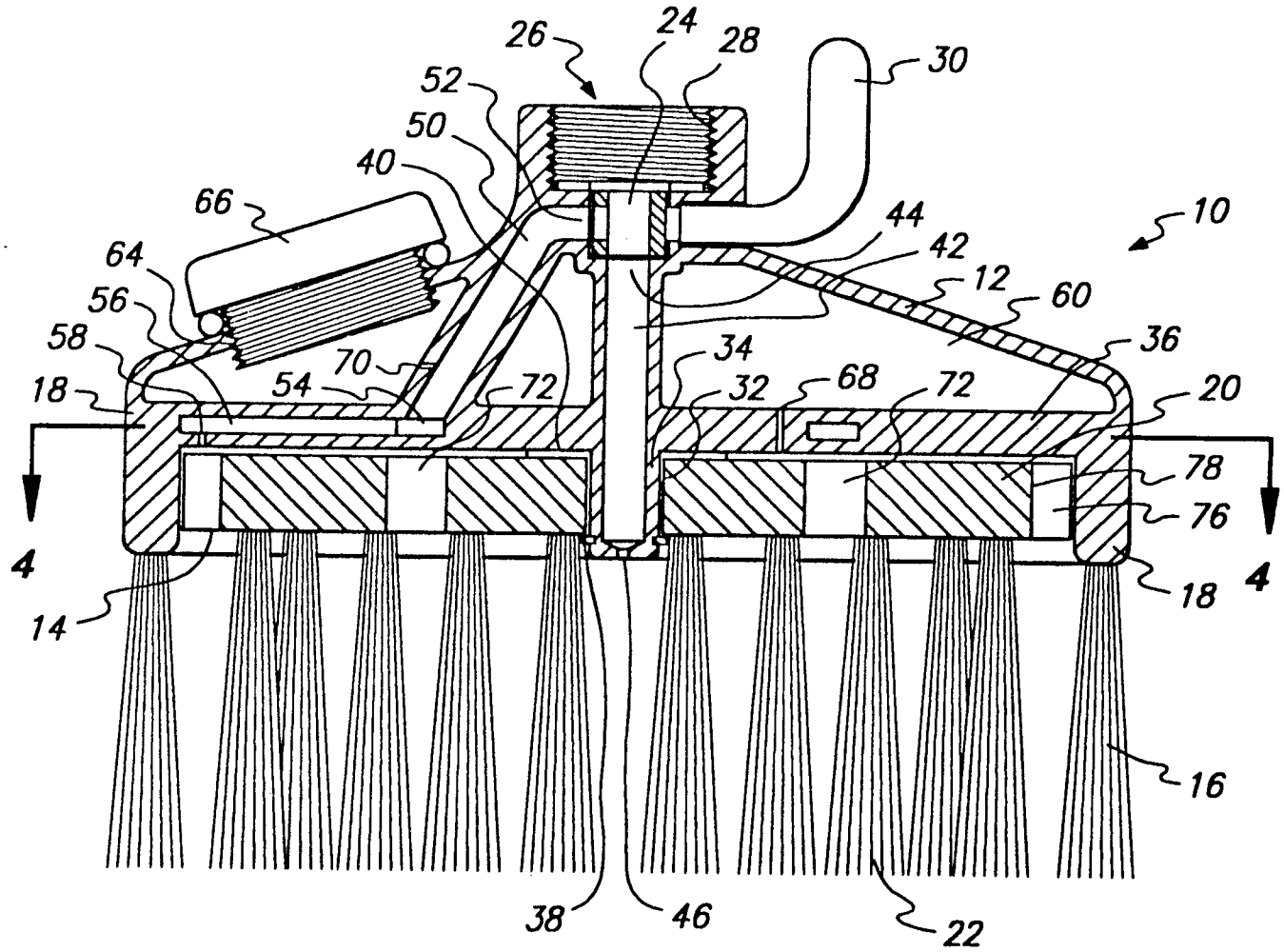
FIG. 3 is a cross-sectional view of the device, along lines 3—3 of FIG. 2.

Referring first to FIGS. 1 and 3, there is shown perspective views of the water operated rotatable scrubbing brush device 10 of the invention connected to a conventional, prior art hand grip water nozzle W which is in turn attached to a garden hose H.

Referring first to FIG. 3, the device 10 has a main, non-rotatable body portion 12 and rotatable brush portion 14. The rotatable brush portion 14 is rotatably positioned on the non-rotatable body portion 12. The non-rotatable body portion 12 has groups of fixed bristles 16 attached to its lower, perimeter edge 18. The rotatable brush portion 14 consists of a rotatable scrubbing disk plate portion 20, from which numerous bunches of bristles 22 extend outwardly. A two-way valve 24 is located downstream of a water inlet orifice 26, which is preferably sized and threaded with female threads 28 to allow engagement with the male threads of a conventional garden hose (not shown.) The two-way valve 24 has an activating lever 30 which allows the user to easily change the direction of the water flow in the device 10, thereby changing the mode of the device, as will be described in greater detail below.

As shown in FIG. 3, the plate portion 20 of the rotatable brush portion 14 has a central hub opening 32 formed therein. A hollow axle portion 34 extends from the bottom wall 36 of the non-rotatable body portion 12, and the central hub opening 32 is sized to allow the rotatable scrubbing disk plate portion 20 to rotate on the hollow axle portion 34. The rotatable brush portion 14 is rotatably retained to the hollow axle portion 34 by a attachment means, such as a C-ring 38, a clip, a nut, or any other conventional means which allows the rotatable brush portion 14 to freely rotate on the hollow axle portion 34, yet remained attached thereto. Preferably, a washer 40 formed of a low friction material, such as teflon, is placed on the hollow axle portion 34 and is positioned between the plate portion 20 and the bottom wall 36 of the non-rotatable body portion 12 to enhance the low friction rotation of the rotatable brush portion 14 on the body portion 12.

A rinse water conduit (or channel) 42 passes through the hollow axle portion 34, and abuts the two-way valve 24 at its top end 44. The two-way valve 24, as its name implies, allows water to be directed two different ways. When the two-way valve 24 is brought to a first, rinse-mode position, as shown in FIG. 3, water will flow downwardly through the two-way valve 24, through the rinse water conduit 42, and out its terminating end 46. A spray nozzle (not shown) can be fixed at the terminating end 46 of the rinse water conduit 42 in order to causes water to spray out in a desired spray or stream.

Figure 4:
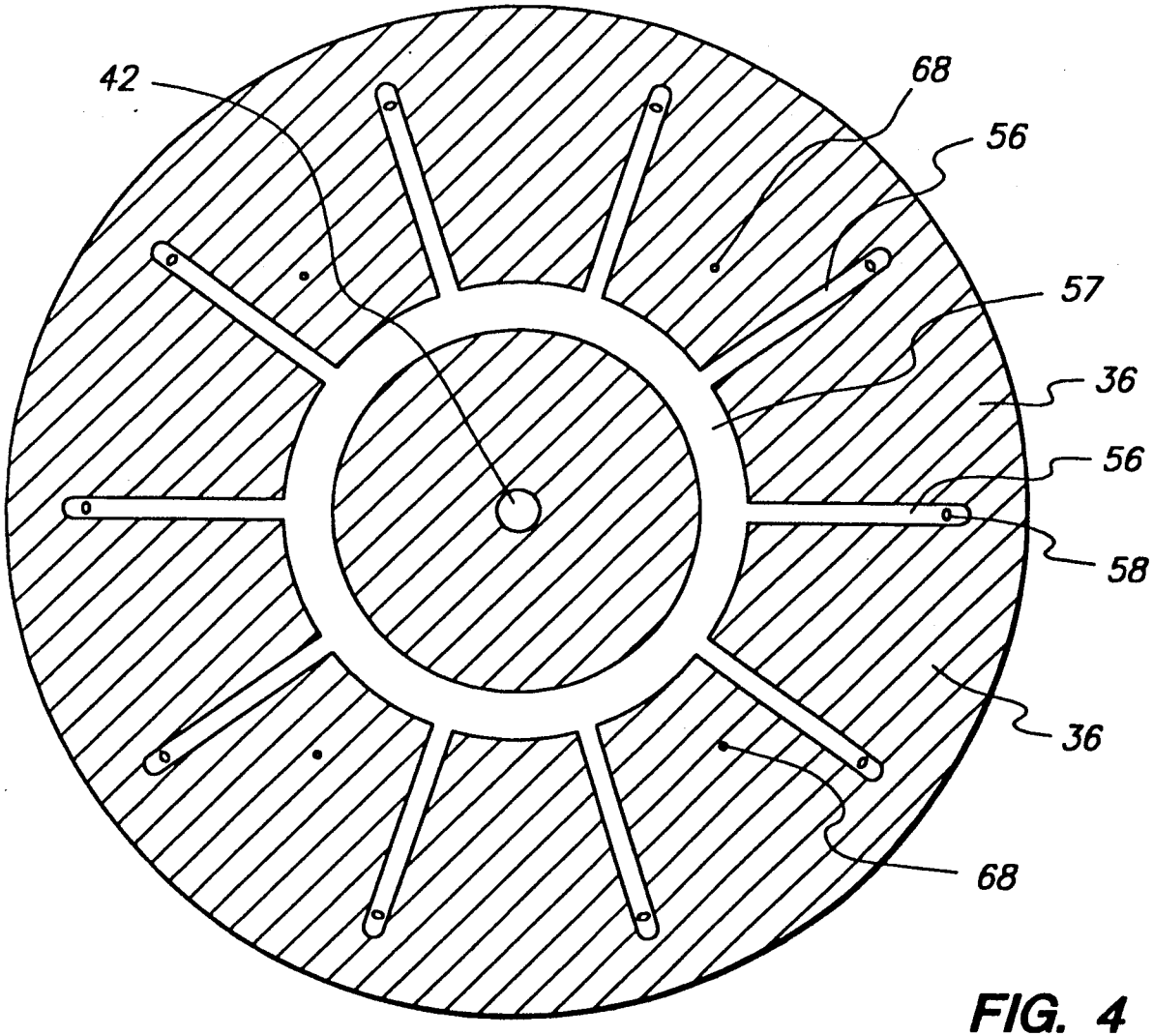
FIG. 4 is a cross-sectional view of the device, along lines 4—4 of FIG. 3.
Figure 5:
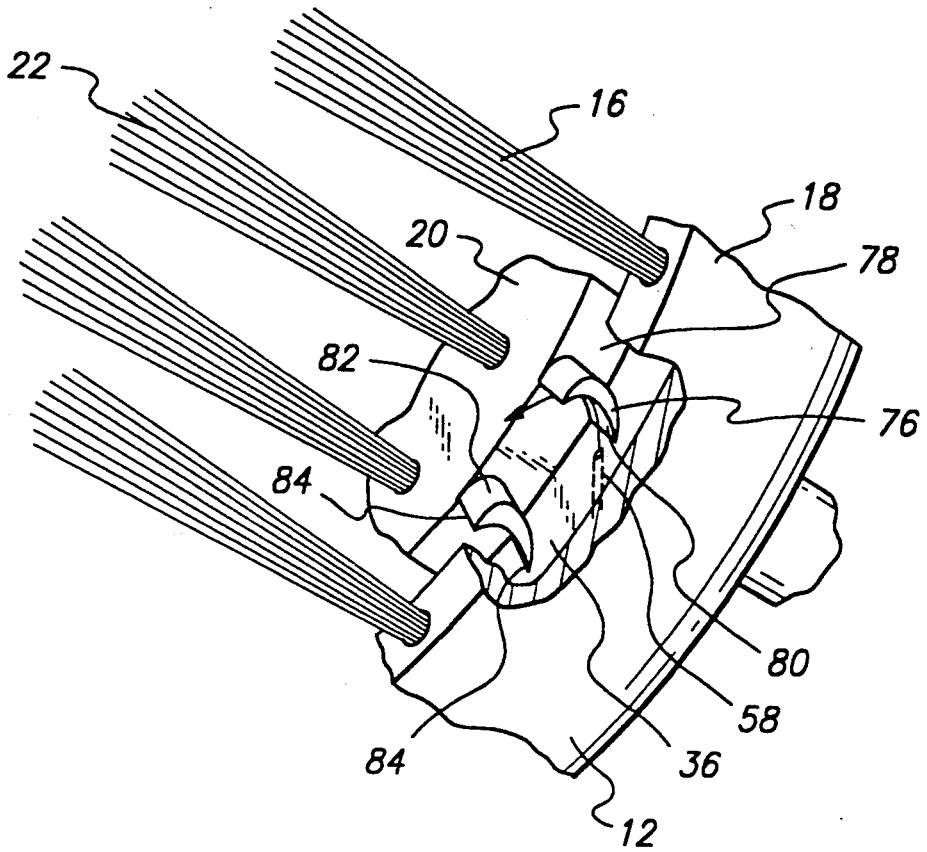
FIG. 5 is a partially exposed detail of the region 5—5 of FIG. 1.

When the two way valve 24 is brought to a second, washing-mode position, water will be directed through a washing water conduit (or channel) 50, which is connected at its upper end 52 to the two-way valve 24. The lower end 54 of the washing water conduit 50 is in fluid connection with a plurality of jet supply conduits 56, via a ring-shaped conduit 57, as best shown in FIGS. 3 and 4. The plurality of jet supply conduits 56 and the ring-shaped conduit 57 are formed in the bottom wall 36 of the non-rotatable body portion 12, and the jet supply conduits 56 extend to near the perimeter edge 18 of the main body portion 12. A single jet 58 is formed partially through the bottom wall 36, and into each of the jet supply conduits 56 near the perimeter edge 18 of the main body portion 12. Referring to FIG. 5, these jets 58 are formed at approximately a 30 degree angle from the plane of the bottom wall 36, and are pointed in the same radial direction. As will be discussed below, these jets 58 provide the pressurized water force which is used to rotate the rotatable brush portion 14.

Referring to FIG. 3, a liquid cleaning solution reservoir (or container) 60 is formed above the bottom wall 36 of the main body portion 12. Liquid cleaning solution, such as soap or detergent, is added to the reservoir 60 via a filling inlet 64, which has a screw cap 66. Pin holes 68 are formed through the bottom wall 36 of the reservoir 60. A small hole 70, about 1/16th of an inch in diameter, is formed in the washing water conduit 50, leading to the reservoir 60. When two-way valve 24 is in the washing mode, water will travel through the washing water conduit 50, and a small amount of water will flow into the reservoir 60 through the small hole 70 in the washing water conduit 50, thereby pressurizing the liquid cleaning solution in the reservoir 60 and forcing it out through the pin holes 68 in the bottom wall 36 of the reservoir 60. On the other hand, when the two-way valve 24 is in the rinse-mode position of FIG. 3, clean water, unmixed with cleaning solution 62 will flow through the rinse water conduit 42, and liquid cleaning solution will not pass out of the reservoir 60. This is because when the reservoir 60 is not being pressurized, the surface tension across the pin holes 68 and the small hole 70 in the wash water conduit 50 will prevent liquid cleaning solution from being released. A number of apertures 72 are formed through the rotatable scrubbing disk plate portion 20, through which the liquid soap solution can pass therethrough and deposit on the bristles 16 and 22 of the device.

Referring to FIGS. 3 and 5, a plurality of water vanes 76 are formed on the perimeter 78 of the rotatable scrubbing disk plate portion 20, and project outwardly away from the perimeter 78. Referring to FIG. 5, these water vanes 76 are generally crescent-shaped in form, and have a concave, cup-shaped water impact surface 80 formed on the trailing surfaces of the vanes 76, which are aligned to intersect water being expelled from the jets 58 formed in the bottom wall 36. The leading surfaces 82 of the water vanes 76 are arched forwardly in the direction of rotation of the rotatable scrubbing disk plate portion 20. The top and bottom edges of the vanes 76 come to blade edges 84. The crescent shape of the vanes 76, with its blade edges 84 ensure that water being expelled from the jets 58 will at all times impact with the cup-shaped impact surface 80 of the vanes 76. The inventor has found that when the jets 58 are directed from the plane of the bottom wall 36 upwardly, at an angle of approximately 30 degrees, most of the force of the water impacting the impact surface 80 of the vanes 76 will provide forward propulsion to the rotatable scrubbing disk plate portion 20. After hitting the impact surface 80, the water pushes the vanes 76 forward, thereby imparting substantially the full force of the water leaving the jets 58 to rotate the rotatable scrubbing disk plate portion 20. The shape of and the arrangement of the plurality of vanes 76 on the perimeter of the plate portion 20, in conjunction with the plurality of jets 58 aligned so that the high pressure water emanating from the jets 58 impacts substantial torque to the rotatable brush portion 14, even when the device 10 is pushed with substantial force against the item being scrubbed.

The operation of the device will now be described, with particular respect to its two-way valve 24, and its two modes of operation. When the two-way valve 24 is brought to the scrub-mode position, water will drive the rotatable brush portion 14, and liquid cleaning solution will be released from the cleaning solution reservoir 60, through the holes 68 in the bottom wall 36, fall onto the rotatable scrubbing disk plate portion 20, and through the apertures 72 formed therethrough, where the liquid cleaning solution will deposit on the bristles 22 of the rotatable brush portion 14, the fixed bristles 16 and the item being cleaned. After the item being cleaned is sufficiently scrubbed and soaped down, the device 10 can be brought to the rinse-mode position of FIG. 3, by simply moving the two-way valve lever 30 to the rinse-mode position, thereby directing clean rinse water outwardly through the rinse water conduit 42, where the clean rinse water is available for rinsing of the item be cleaned.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims:

I claim:

1. A water operated rotatable scrubbing brush device, comprising:

a non-rotatable body portion;

a rotatable scrubbing disk plate which is rotatably carried on an extension of a rinse water channel which extends outwardly from the underside of said non-rotatable body, said rotatable scrubbing disk plate carrying scrubbing members on an underside thereof, and a plurality of water vanes located on its circumference;

a two-way valve with a water inlet for connection to a water supply, and two outlets through which water can be selectively directed, the first outlet being in fluid communication with the rinse water channel which exits the device, and a second outlet which is in fluid communication with a wash water channel, said wash water channel being in fluid communication with a plurality of jets which are aligned to direct water flowing therefrom to the vanes on the circumference of the rotatable scrubbing disk plate, and thereby drive the rotatable scrubbing disk plate, whereas when the user of the device desires to actuate a rotatable scrubbing mode of the device, the user positions the two-way valve to direct water through the wash water channel and jets, and when the user wishes to actuate a rinse mode of the device, the user positions the two-way valve to direct water through the rinse water channel, so that the water exits the device without rotating the rotatable scrubbing disk plate, and without intercepting the rotatable scrubbing disk plate.

2. The water operated rotatable scrubbing brush device of claim 1, wherein said non-rotatable body portion further comprises a container for containing a liquid cleaning solution, said container having outlets through which the liquid cleaning solution is released to the rotatable scrubbing disk plate during the rotatable scrubbing mode of the device.

3. The water operated rotatable scrubbing brush device of claim 1, wherein each of the vanes of the rotatable scrubbing disk plate are crescent-shaped and extend outwardly from the circumference of the rotatable scrubbing disk and have a convex leading surface facing the direction of rotation of the rotatable scrubbing disk plate, and a concave water impact surface on a trailing surface, upon which water from the jets will impinge.

4. The water operated rotatable scrubbing brush device of claim 1, wherein the jets are oriented so as to direct water at approximately a 30 degree offset from the plane of the underside of said non-rotatable body, towards said vanes, and thereby efficiently drive the rotatable scrubbing disk plate.

5. The water operated rotatable scrubbing brush device of claim 4, wherein the jets comprise channels formed in the underside of said non-rotatable body portion.

6. The water operated rotatable scrubbing brush device of claim 1, further comprising a plurality of scrubbing bristles positioned around a perimeter of the underside of the non-rotatable body portion and wherein said scrubbing members positioned on the underside of the rotatable scrubbing disk plate comprise groups of bristles.

7. A water operated rotatable scrubbing brush device, comprising:

a non-rotatable body portion with a container for containing a liquid cleaning solution, said container having a bottom wall with apertures formed therethrough from which the liquid cleaning solution can exit;

a rotatable scrubbing disk plate which is rotatably carried on an underside of said non-rotatable body, said rotatable scrubbing disk plate carrying scrubbing brush members on an underside thereof, and a plurality of water vanes located on its circumference; and a two-way valve with a water inlet for connection to a water supply, and two outlets through which water can be selectively directed, a first outlet being in fluid communication with a rinse water channel which exits along an axis line of the rotatable scrubbing disk plate, and a second outlet which is in fluid communication with a wash water channel, said wash water channel being in fluid communication with a plurality of jets which are aligned to direct water flowing therefrom to the vanes on the circumference of the rotatable scrubbing disk plate, and thereby drive the rotatable scrubbing disk plate, said wash water channel having an aperture formed therethrough and in communication with the container of the non-rotatable body portion, wherein said rotatable scrubbing disk plate is rotatably mounted on an extension of the rinse water channel which extends downwardly from the underside of the non-rotatable body portion, thereby allowing rinse water to exit from the rinse water channel without intercepting the rotatable scrubbing disk plate;

whereby when the user of the device desires to actuate a rotatable scrubbing mode of the device, the user positions the two-way valve so as to direct water through the wash water channel and jets, which directs a portion of the water flowing through the wash water channel, through the aperture formed therein, and into the container, thereby forcing liquid cleaning solution out of the container through the aperture formed on its bottom wall and onto the rotatable scrubbing disk plate, and when the user wishes to actuate the rinse mode of the device, the user positions the two-way valve to direct water through the rinse water channel, so that the water exits the device without rotating the rotatable scrubbing disk plate and without drawing any liquid cleaning solution into the rinse water.

* * * * *